US010679783B2

(12) United States Patent
Zhang et al.

(10) Patent No.: US 10,679,783 B2
(45) Date of Patent: Jun. 9, 2020

(54) NETWORK TRANSFORMER APPARATUS AND METHODS OF MAKING AND USING THE SAME

(71) Applicant: Pulse Electronics, Inc., San Diego, CA (US)

(72) Inventors: Chunlei Zhang, Zhuhai (CN); Sheshe Zhao, Qian (CN); Yonggang Wang, Chifeng (CN)

(73) Assignee: PULSE ELECTRONICS, INC., San Diego, CA (US)

( * ) Notice: Subject to any disclaimer, the term of this patent is extended or adjusted under 35 U.S.C. 154(b) by 197 days.

(21) Appl. No.: 15/782,670

(22) Filed: Oct. 12, 2017

(65) Prior Publication Data

US 2019/0043651 A1 Feb. 7, 2019

Related U.S. Application Data

(60) Provisional application No. 62/541,598, filed on Aug. 4, 2017.

(51) Int. Cl.

| | |
|---|---|
| ***H01F 27/02*** | (2006.01) |
| ***H01F 17/06*** | (2006.01) |
| ***H01F 41/08*** | (2006.01) |
| ***H01F 29/14*** | (2006.01) |
| ***H01F 27/40*** | (2006.01) |
| ***H01F 19/00*** | (2006.01) |
| ***H01F 27/38*** | (2006.01) |
| *H01R 13/66* | (2006.01) |

(52) U.S. Cl.

CPC ..... *H01F 17/062* (2013.01); *H01F 19/00* (2013.01); *H01F 27/02* (2013.01); *H01F 27/38* (2013.01); *H01F 27/40* (2013.01); *H01F 29/146* (2013.01); *H01F 41/08* (2013.01); *H01F 27/027* (2013.01); *H01R 13/6691* (2013.01)

(58) Field of Classification Search

CPC ..... H01F 27/00–36
USPC ..... 336/65, 83, 200, 212–215, 232–234
See application file for complete search history.

(56) References Cited

U.S. PATENT DOCUMENTS

| | | | | |
|---|---|---|---|---|
| 3,985,310 | A | 10/1976 | Kent et al. | |
| 5,923,237 | A | 7/1999 | Sato et al. | |
| 6,691,398 | B2 | 2/2004 | Gutierrez | |
| 7,612,641 | B2 | 11/2009 | Jean et al. | |
| 8,147,287 | B2 | 4/2012 | Negishi | |
| 8,845,367 | B2 | 9/2014 | Gutierrez et al. | |
| 2014/0179163 | A1* | 6/2014 | Zhang | H01R 13/6658 439/620.15 |

(Continued)

*Primary Examiner* — Tuyen T Nguyen
(74) *Attorney, Agent, or Firm* — Gazdzinski & Associates, PC

(57) ABSTRACT

Network transformer structures including a production method therefore are disclosed. In one embodiment, multiple integrated I-shaped magnetic cores that include three winding barrel portions based on a new design for a magnetic core structure is disclosed. A first winding barrel portion and a second winding barrel portion are configured to wind a transformer winding, and a third winding barrel portion is configured to wind a common mode choke winding, so that a transformer and a common mode choke are combined onto one magnetic core to replace two previous magnetic cores, thereby saving on the overall network transformer structure cost as well as space on, for example, an end consumer printed circuit board.

21 Claims, 12 Drawing Sheets

(56) References Cited

U.S. PATENT DOCUMENTS

2017/0178783 A1* 6/2017 Lou ..... H01F 27/24
2019/0156993 A1* 5/2019 Lou ..... H01F 27/027

* cited by examiner

NETWORK TRANSFORMER APPARATUS AND METHODS OF MAKING AND USING THE SAME

PRIORITY

This application claims the benefit of priority to U.S. Provisional Patent Application Ser. No. 62/541,598 entitled "Network Transformer Structure and Production Method Therefor" filed Aug. 4, 2017, which is incorporated herein by reference in its entirety.

COPYRIGHT

A portion of the disclosure of this patent document contains material that is subject to copyright protection. The copyright owner has no objection to the facsimile reproduction by anyone of the patent document or the patent disclosure, as it appears in the Patent and Trademark Office patent files or records, but otherwise reserves all copyright rights whatsoever.

TECHNOLOGICAL FIELD

The present invention relates to the technology of magnetic core modules, and in one exemplary aspect to a network transformer structure having both a transformer winding and a common mode winding on a single magnetic core module.

DESCRIPTION OF RELATED TECHNOLOGY

Traditionally, inductive devices such as, for example, transformers and common mode chokes have been used in, for example, Ethernet and other data-related applications. Both of these transformers and common mode chokes may be manufactured by, for example, manually or automatically winding magnet wires on a toroidal ferrous core. One exemplary apparatus for the automated winding of these toroidal cores is described in co-owned U.S. Pat. No. 3,985,310 to Kent, et al. the contents of which are incorporated herein by reference in its entirety. However, in practice, toroidal cores are often wound manually, whether entirely by hand, or a combination of a manual operator and a winding machine, for a variety of reasons including cost efficiency and consistency. Moreover, securing the termination wires from these wound toroidal cores has always been done manually, as it has been difficult for automated processing equipment to easily identify the different wires for routing to different termination points. In addition, these transformers and common mode chokes have been utilized on discrete toroidal cores within, for example, many common networking applications such as Ethernet and Gigabit Ethernet applications. However, there use has often put limitations on the overall end device size Moreover, the downward pressure on pricing for these magnetic components often makes manually wound transformers unsuitable in more cost-sensitive end applications such as in, for example, integrated connector modules (ICMs). Accordingly, there remains an unsatisfied need for magnetic components that can provide one or more of the following: (1) be manufactured using (at least primarily) automated processes; (2) reduce the footprint for the magnetics used in end customer applications; and (3) incorporate one or more integrated center tap connections, all while (4) forming a substantially closed magnetic path in order to reduce the harmful and deleterious effects associated with electromagnetic interference (EMI).

SUMMARY

The present disclosure satisfies the aforementioned needs by providing, inter alia, an improved network transformer apparatus and methods for manufacturing and using the same.

In a first aspect, an inductive device is disclosed. In one embodiment, the inductive device includes a network transformer structure that includes a magnetic core module having a flat magnetic core and a plurality of integrated I-shaped magnetic cores, the flat magnetic core being disposed on the plurality of integrated I-shaped magnetic cores so as to form a closed magnetic structure. The plurality of integrated I-shaped magnetic cores further includes a transformer winding that includes a primary winding and a secondary winding and a common mode choke winding; and the transformer winding is magnetically isolated from the common mode choke winding by virtue of the closed magnetic structure.

In one variant, the plurality of integrated I-shaped magnetic cores includes a first winding barrel portion, a second winding barrel portion, and a third winding barrel portion, the primary winding and the secondary winding being disposed on the first winding barrel portion and the second winding barrel portion, and the common mode choke winding is disposed on the third winding barrel portion.

In another variant, a first flange is disposed on a first end of the plurality of integrated I-shaped magnetic cores, a second flange is disposed between the first winding barrel portion and the second winding barrel portion, a third flange is disposed between the second winding barrel portion and the third winding barrel portion, and a fourth flange is disposed on a second opposing end of the plurality of integrated I-shaped magnetic cores opposite the first end.

In yet another variant, the common mode choke winding includes a first winding and a second winding, the secondary winding comprised of a same piece of wire as the second winding; and the third flange includes a wire passing groove disposed on an external surface of the third flange, a portion of the same piece of wire being disposed in the wire passing groove.

In yet another variant, the network transformer structure includes an external conductive device that connects a first terminal pad located on the third flange with a second terminal pad located on the second flange.

In yet another variant, the network transformer structure includes an external conductive device that connects a first terminal pad located on the third flange with a second terminal pad located on the first flange.

In a second embodiment, the network transformer structure includes: a magnetic core module, the magnetic core module including a flat magnetic core, and multiple integrated I-shaped magnetic cores, the multiple I-shaped magnetic cores being configured to be arranged on the flat magnetic core, the multiple I-shaped magnetic cores further including a first flange, a transformer barrier, a third flange, and a fourth flange, each of the first flange, the transformer barrier, the third flange and the fourth flange collectively including a plurality of terminal pads; a first winding barrel portion is arranged between the first flange and the transformer barrier; a second winding barrel portion is arranged between the transformer barrier and the third flange; a third winding barrel portion is arranged between the third flange and the fourth flange; a transformer winding, the transformer winding including a primary winding and a secondary winding, the primary winding and the secondary winding are wound onto the first winding barrel portion and the second winding barrel portion; an input end of the primary winding is welded onto a first terminal pad of the plurality of terminal pads, a center tap of the primary winding is welded onto a second terminal pad of the plurality of terminal pads, and an output end of the primary winding is welded onto a third terminal pad of the plurality of terminal pads; an input end of the secondary winding is welded onto a fourth terminal pad, and a center tap of the secondary winding is welded onto a fifth terminal pad; a common mode choke winding includes a first winding and a second winding, both of which having a same number of turns and phases, but are wound in an opposite direction from one another, the first winding and the second winding are wound onto the third winding barrel portion; a first end of the first winding is welded onto a sixth terminal pad of the plurality of terminal pads, and a second end of the first winding is welded onto a seventh terminal pad of the plurality of terminal pads; and an output end of the secondary winding is welded onto the sixth terminal pad, and a second end of the secondary winding is welded onto an eighth terminal pad of the plurality of terminal pads.

In one variant, the fourth terminal pad and the sixth terminal pad are connected through an external conductive device, so that the input end of the secondary winding of the transformer winding and the first end of the first winding of the common mode choke winding are connected.

In another variant, the external conductive device that connects the fourth terminal pad and the sixth terminal pad includes a wire, the wire configured to pass through a wire passing groove located on a front side wall of the transformer barrier.

In yet another variant, the common mode choke winding further includes a third winding; the third winding, the first winding, and the second winding are wound onto the third winding barrel portion.

In yet another variant, the fourth flange includes a ninth terminal pad of the plurality of terminal pads; a first end of the third winding is welded onto the fifth terminal pad; and a second end of the third winding is welded onto the ninth terminal pad.

In yet another variant, a portion of wire of the third winding between the fifth terminal pad and the third winding barrel portion passes through a wire passing groove located on a side of the third flange.

In yet another variant, the network transformer structure further includes a tenth terminal pad P located on the third flange; a first end of the third winding is welded onto the tenth terminal pad; a second end of the third winding is welded onto a ninth terminal pad; and the tenth terminal pad and the ninth terminal pad are connected by a conductive device.

In yet another variant, an external conductive device is disposed between a tenth terminal pad and a ninth terminal pad, the tenth terminal pad is disposed on the third flange and the tenth terminal pad is disposed on the fourth flange.

In yet another variant, the external conductive device includes a printed circuit board (PCB) trace.

In yet another variant, a plurality of wire passing grooves are arranged on two side walls of each of the first flange, the transformer barrier, the third flange, and the fourth flange; and a connection between an output end of the secondary winding of the transformer and the output end of the secondary winding of the common mode choke passes through a wire passing groove on a front side wall of the third flange.

In yet another variant, a first portion of wire between the input end of the primary winding and the center tap of the primary winding is wound onto the first winding barrel portion; a second portion of wire between the center tap of the primary winding and an output end of the primary winding is wound onto the second winding barrel portion; a third portion of wire between the input end of the primary winding and the center tap of the secondary winding is wound onto the first winding barrel portion; and a fourth portion of wire between the center tap of the secondary winding and the output end of the secondary winding is wound onto the second winding barrel portion.

In yet another variant, the fourth flange includes a ninth terminal pad and a first end of the third winding is welded onto the fifth terminal pad and a second end of the third winding is welded onto the ninth terminal pad.

In a second aspect, methods of manufacturing the aforementioned inductive devices are disclosed. In one embodiment, the method includes procuring or manufacturing a flat magnetic core, multiple integrated I-shaped magnetic cores, a first wire, a second wire, and a third wire, where the first wire is served as a primary winding of a transformer, where the second wire is simultaneously served as a secondary winding of the transformer and a second winding of a common mode choke, and the third wire is served as a first winding of the common mode choke; defining one end of the first wire as an input end of the primary winding of the transformer, and welding the one end of the first wire onto a first terminal pad; defining one end of the second wire as an input end of the secondary winding of the transformer, and welding the one end of the second to a fifth terminal pad; then, winding the first wire and the second wire for several turns along a first winding barrel portion; after the first winding is wound on the first winding barrel portion, extending the first wire to a second terminal pad and welding onto the second terminal pad, a portion of the first wire welded to the second terminal pad comprising a center tap of the primary winding; extending the second wire to a sixth terminal pad, and welding onto the sixth terminal pad, a portion of the second wire welded to the sixth terminal pad comprising a center tap of the secondary winding of the transformer; then winding the first wire and the second wire for several turns along a second winding barrel portion; after the second winding barrel portion is wound, extending the first wire to a third terminal pad, and welding the first wire onto the third terminal pad; extending the second wire into a wire passing groove on a front side wall of a third flange, a portion of the second wire located in the wire passing groove simultaneously comprising an output end of the secondary winding of the transformer and a first end of the second winding of the common mode choke; later, defining one end of the third wire as a first end of the first winding of the common mode choke, and welding onto a seventh terminal pad, and then winding the rest of the second wire and the third wire for several turns along a third winding barrel portion; when the third winding barrel portion is wound, extending a terminal end of the second wire to an eighth terminal pad, and welding the terminal end onto the eighth terminal pad; extending a terminal end of the third wire to a fourth terminal pad, and welding onto the fourth terminal pad; connecting the fifth terminal pad with the seventh terminal pad with an external conductive device, so that the input end of the secondary winding of the transformer and the first end of the first winding of the common mode choke are connected; and bonding the flat magnetic core to the multiple integrated I-shaped magnetic cores, so as to constitute a closed magnetic circuit, the bonding resulting in the transformer being formed between a first flange and the third flange, and the common mode choke being formed between the third flange and a fourth flange.

In one variant, the method further includes adding a third winding of the common mode choke winding to the network transformer structure, the adding including winding the third winding onto the third winding barrel portion so as to form a three-wire common mode choke winding.

In a third aspect, methods of using the aforementioned inductive devices are disclosed. In one embodiment, the method includes procuring the aforementioned inductive device, the inductive device including a network transformer structure that includes a magnetic core module having a flat magnetic core and a plurality of integrated I-shaped magnetic cores, the flat magnetic core being disposed on the plurality of integrated I-shaped magnetic cores so as to form a closed magnetic structure. The plurality of integrated I-shaped magnetic cores further includes a transformer winding that includes a primary winding and a secondary winding and a common mode choke winding; and the transformer winding is magnetically isolated from the common mode choke winding by virtue of the closed magnetic structure.

In a fourth aspect, an integrated connector module (ICM) which incorporates one or more of the aforementioned inductive devices are disclosed. In one embodiment, the ICM includes an RJ type receptacle connector, a printed circuit board, a plurality of first terminals with one end of the first terminals being coupled with the printed circuit board and another end of the first terminals being disposed within the RJ type receptacle connector. A second plurality of terminals having a first end for interfacing with an external printed circuit and a second end for interfacing with the printed circuit board. An inductive device being disposed on the printed circuit board, the inductive device including a network transformer structure that includes a magnetic core module having a flat magnetic core and a plurality of integrated I-shaped magnetic cores, the flat magnetic core being disposed on the plurality of integrated I-shaped magnetic cores so as to form a closed magnetic structure.

In a fifth aspect, a discrete electronic component that incorporates one or more of the aforementioned inductive devices is also disclosed. In some embodiments, the discrete electronic component may include a printed circuit board. The printed circuit board may be incorporated into a polymer header.

In one variant, the polymer header may be obviated in favor of the utilization of a transfer molding processing technique.

In another aspect of the present disclosure, a network transformer structure is disclosed.

In one embodiment thereof, the network transformer structure includes a magnetic core module, the magnetic core module including: a planar magnetic core, and multiple I-shaped magnetic cores integral therewith; a first winding barrel portion; a second winding barrel portion; and a third winding barrel portion. In one variant, the network transformer structure further includes a transformer winding; and a common mode choke winding.

In another embodiment thereof, the network transformer structure includes a magnetic core module including a planar magnetic core and a plurality of integrated I-shaped magnetic cores; where the plurality of integrated I-shaped magnetic cores further include a transformer winding comprised of a primary winding and a secondary winding and a common mode choke winding. In one variant, the transformer winding is magnetically isolated from the common mode choke winding by virtue of the closed magnetic structure.

Other features and advantages of the present disclosure will immediately be recognized by persons of ordinary skill in the art with reference to the attached drawings and detailed description of exemplary implementations as given below.

BRIEF DESCRIPTION OF THE DRAWINGS

The features, objectives, and advantages of the disclosure will become more apparent from the detailed description set forth below taken in conjunction with the drawings, wherein.

Figure 1:
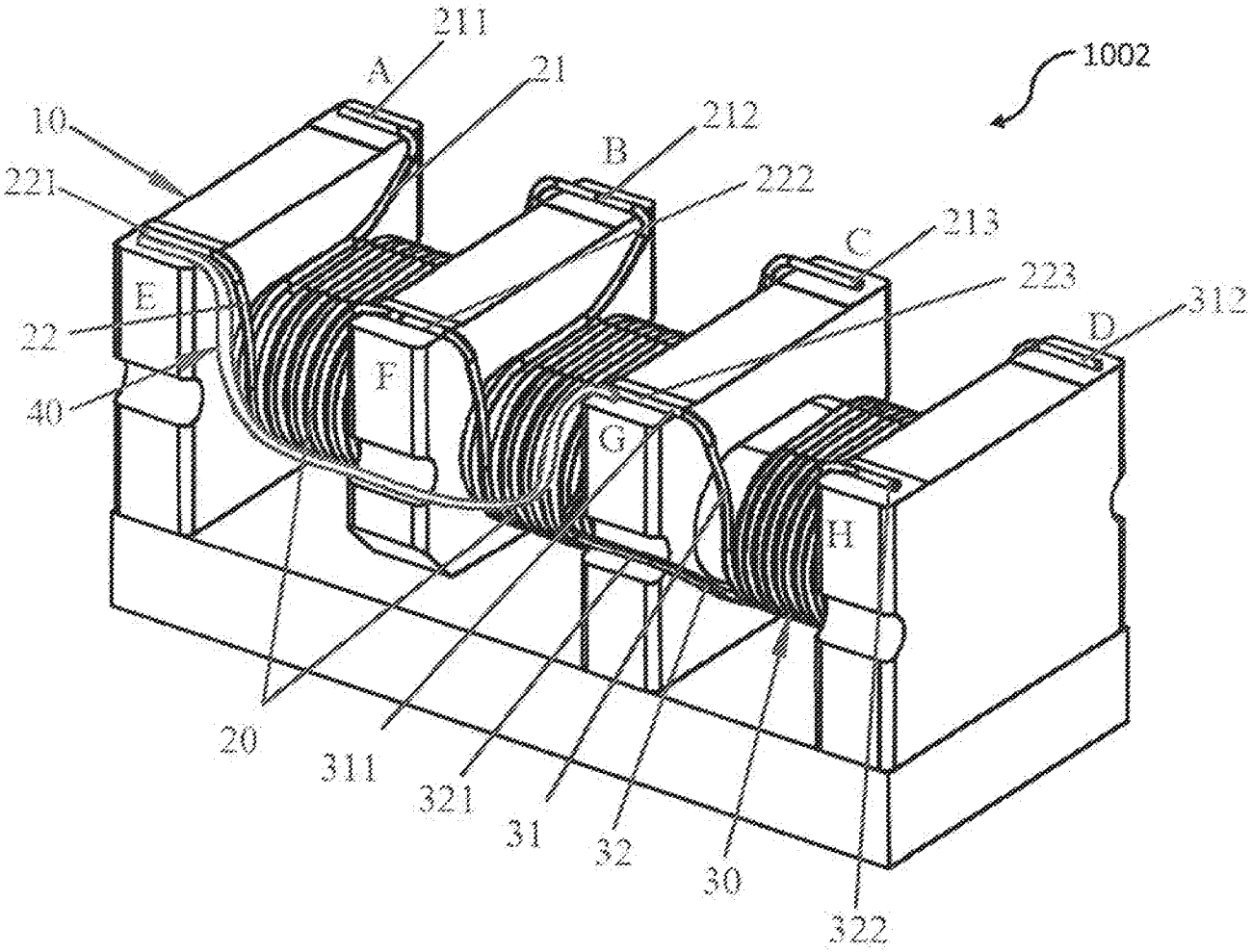
FIG. 1 is a perspective view of one embodiment of a network inductive device in accordance with the principles of the present disclosure.

All Figures disclosed herein are © Copyright 2017 Pulse Electronics, Inc. All rights reserved.

DETAILED DESCRIPTION

Reference is now made to the drawings, wherein like numerals refer to like parts throughout.

As used herein, the terms "electrical component" and "electronic component" are used interchangeably and refer to components adapted to provide some electrical and/or signal conditioning function, including without limitation inductive reactors ("choke coils" or "choke windings"), transformers, filters, transistors, gapped core toroids, inductors (coupled or otherwise), capacitors, resistors, operational amplifiers, and diodes, whether discrete components or integrated circuits, whether alone or in combination.

As used herein, the term "magnetically permeable" refers to any number of materials commonly used for forming inductive cores or similar components, including without limitation various formulations made from ferrite.

As used herein, the term "signal conditioning" or "conditioning" shall be understood to include, but not be limited to, signal voltage transformation, filtering and noise mitigation, signal splitting, impedance control and correction, current limiting, capacitance control, and time delay.

As used herein, the terms "top", "bottom", "side", "up", "down" and the like merely connote a relative position or geometry of one component to another, and in no way connote an absolute frame of reference or any required orientation. For example, a "top" portion of a component may actually reside below a "bottom" portion when the component is mounted to another device (e.g., to the underside of a PCB). As but yet another example, the terminal pads A and E are described as being arranged at both sides of the top of the first flange 121 in FIG. 1; however, in many common usage scenarios, the top of the first flange 121 in FIG. 1 will actually reside below, for example, the flat magnetic core 11 when mounted to the top-side of an end consumer PCB.

Overview

In one aspect, an exemplary network transformer structure is disclosed that includes a magnetic core module that includes multiple integrated I-shaped magnetic cores that have three winding barrel portions. The first and second winding barrel portions may be configured to house a transformer winding that includes, for example, a primary winding and a secondary winding. The third winding barrel portion may be configured to include two or more common mode choke windings. As a result, the aforementioned network transformer structure may include both a transformer and a common mode choke on, for example, a single magnetic core module. Methods of manufacturing and using the aforementioned network transformer structure are also disclosed.

DETAILED DESCRIPTION OF EXEMPLARY EMBODIMENTS

It will be recognized that while the following discussion is cast primarily in terms of an exemplary magnetic core module that includes multiple integrated I-shaped magnetic cores that have three winding barrel portions with the first winding barrel portion and a second winding barrel portion configured to wind a transformer winding, and a third winding barrel portion configured to wind a common mode choke winding, so that both a transformer and a common mode choke are combined onto one magnetic core, the principles of the present disclosure are not so limited. It would be readily apparent to one of ordinary skill that the same (or similar) principles may apply to alternative core shapes and alternative core assemblies. For example, some implementations may include four (4) or more winding barrel portions with five (5) or more flanges with the division between transformer and common mode choke being readily divided amongst them dependent upon specific design constraints.

Moreover, it will be recognized that while the following discussion is cast in terms of a transformer that is utilized in conjunction with a common mode choke on a single magnetic core module, it would be readily apparent to one of ordinary skill given the present disclosure that more transformer windings (e.g., two primary windings and/or two secondary windings) may be utilized in conjunction with one or more common mode chokes in some implementations. Finally, it will be recognized that while the following discussion is primarily cast in terms of center-tapped transformer implementations, it would be readily apparent to one of ordinary skill given the present disclosure that the same principles may apply to non-center-tapped transformers in some implementations.

Exemplary Network Inductive Structures

Referring now to FIGS. 1-4, a first exemplary embodiment of a network transformer apparatus 1002 is shown and described in detail. The network transformer apparatus 1002 includes a magnetic core module 10, a transformer winding 20, a common mode choke winding 30, with both the transformer winding 20 and the common mode choke winding 30 being wound on the magnetic core module 10. In combination, the transformer winding 20 and the common mode choke winding 30 act to complete the signal conditioning function for the network transformer apparatus in accordance with some implementations. The magnetic core module 10 may include a flat magnetically permeable core 11, and multiple I-shaped magnetically permeable cores 12. The flat magnetic core 11 may be utilized to constrain magnetic flux fields generated during operation of the network transformer apparatus, thereby mitigating the effects of electromagnetic interference (EMI) for, for example, other electronic components located in proximity to the network transformer apparatus in end consumer applications (e.g., that are disposed in proximity to the network transformer apparatus when installed on, for example, a printed circuit board (PCB) or other suitable substrate).

In some implementations, the multiple I-shaped magnetic cores 12 are integrated together so as to form a single unitary magnetic piece such as that shown in, for example, FIG. 1. However, in some implementations it may be desirable to couple separate I-core portions so as to collectively form the multiple I-shaped magnetic cores 12 as is illustrated in, for example, FIG. 1. In implementations in which separate I-core portions are utilized, these I-core portions may be mechanically secured using, for example, a mechanical clip and/or may be utilized in conjunction with an epoxy that when cured secures these I-core portions together and/or may be mechanically secured using other known securing mechanisms. Referring again to FIGS. 1-2, the multiple I-shaped magnetic cores 12 are arranged onto the flat magnetic core 11, with the multiple I-shaped magnetic cores 12 including a first flange 121, a second flange 122, a third flange 123 and a fourth flange 124. The second flange 122 may act as a transformer barrier 122 in the illustrated example. In other words, the second flange 122 may act to contain the magnetic flux generated within a first winding barrel portion 125 from leaking into the second winding barrel portion 126 and vice versa.

In some implementations, terminal pads A and E are arranged at both sides of the top of the first flange 121, terminal pads B and F are arranged at both sides of the top of the second flange 122, terminal pads C and G are arranged at both sides of the top of the third flange 123, and terminal pads D and H are arranged at both sides of the top of the fourth flange 124. In some implementations, one or more of these terminal pads A, E, B, F, C, G, D, H may be formed onto their respective flanges using the techniques described in co-owned U.S. Pat. No. 7,612,641 filed on Sep. 20, 2005 and entitled "Simplified Surface-Mount Devices and Methods", the contents of which being incorporated herein by reference in its entirety. However, it is appreciated that in some implementations, that one or more of terminal pads A, E, B, F, C, G, D, H may be obviated in favor of separate terminals (such as gull-wing terminals, through-hole terminals, other types of surface mountable or through hole mounted terminals).

Moreover, in some implementations it may be desirable that, for example, terminal pad A may extend onto one (or both) sides of the first flange 121 so as to enable, for example, improved mechanical strength (and improved electrical connectivity) between the magnetic core module 10 and external printed circuit boards (such as those utilized within an external networking device, as but one example) during soldering operations. In other words, by extending the terminal pad A onto one (or both) sides of the first flange 121, an improved soldering fillet may reside on end consumer substrates (e.g., PCB's) during soldering operations resulting in improved resistance to shock and vibration qualification testing during network transformer apparatus qualification testing. Other one(s) of the terminal pads may also be readily adapted to have the terminal pads extended onto one (or both) sides of their respective flanges. The multiple I-shaped magnetic cores 12 may include a first winding barrel portion 125 arranged between the first flange 121 and the second flange 122, a second winding barrel portion 126 arranged between the second flange 122 and the third flange 123, and a third winding barrel portion 127 arranged between the third flange 123 and the fourth flange 124.

In some implementations, the windings utilized in conjunction with, for example, the magnetic core module 10 may consist of a transformer winding 20 and a common mode choke winding 30. The transformer winding 20 may include a primary winding 21 and a secondary winding 22 in some implementations, although it will be appreciated that certain design variants may include two or more primary windings and/or two or more secondary windings in some implementations. In the illustrated embodiment, the primary winding 21 and the secondary winding 22 are both wound onto the first winding barrel portion 125 and the second winding barrel portion 126; an input end 211 of the primary winding 21 is secured onto the terminal pad A, a center tap 212 of the primary winding is secured onto the terminal pad B, and an output end 213 of the primary winding 21 is secured onto terminal pad C. In alternative variations, the center tap portion of the primary winding may be obviated so that the primary winding only possesses an input end 211 and an output end 213 (e.g., the "center tap portion" may not be secured to a terminal at all, rather it may be routed through a wire passing groove 128 as but one example).

In some implementations, the securing of the conductive winding to terminal pads A, B, C is accomplished via the use of resistance welding techniques. In other implementations, the securing of the conductive winding to terminal pads A, B, C is accomplished via the use of a eutectic soldering operation (e.g., solder reflow, solder dipping operations and the like). Similarly, in some implementations an input end 221 of the secondary winding 22 is secured onto the terminal pad E, a center tap 222 of the secondary winding 22 is secured onto the terminal pad F. The secondary winding may be secured to the terminal pads using one or more of the aforementioned techniques described with respect to the primary winding 21. Additionally, the center tap portion of the secondary winding may be obviated in some implementations (e.g., through the routing of the "center tap portion" of the winding through a wire passing groove 128 without securing this "center tap portion" to a terminal).

Figure 2:
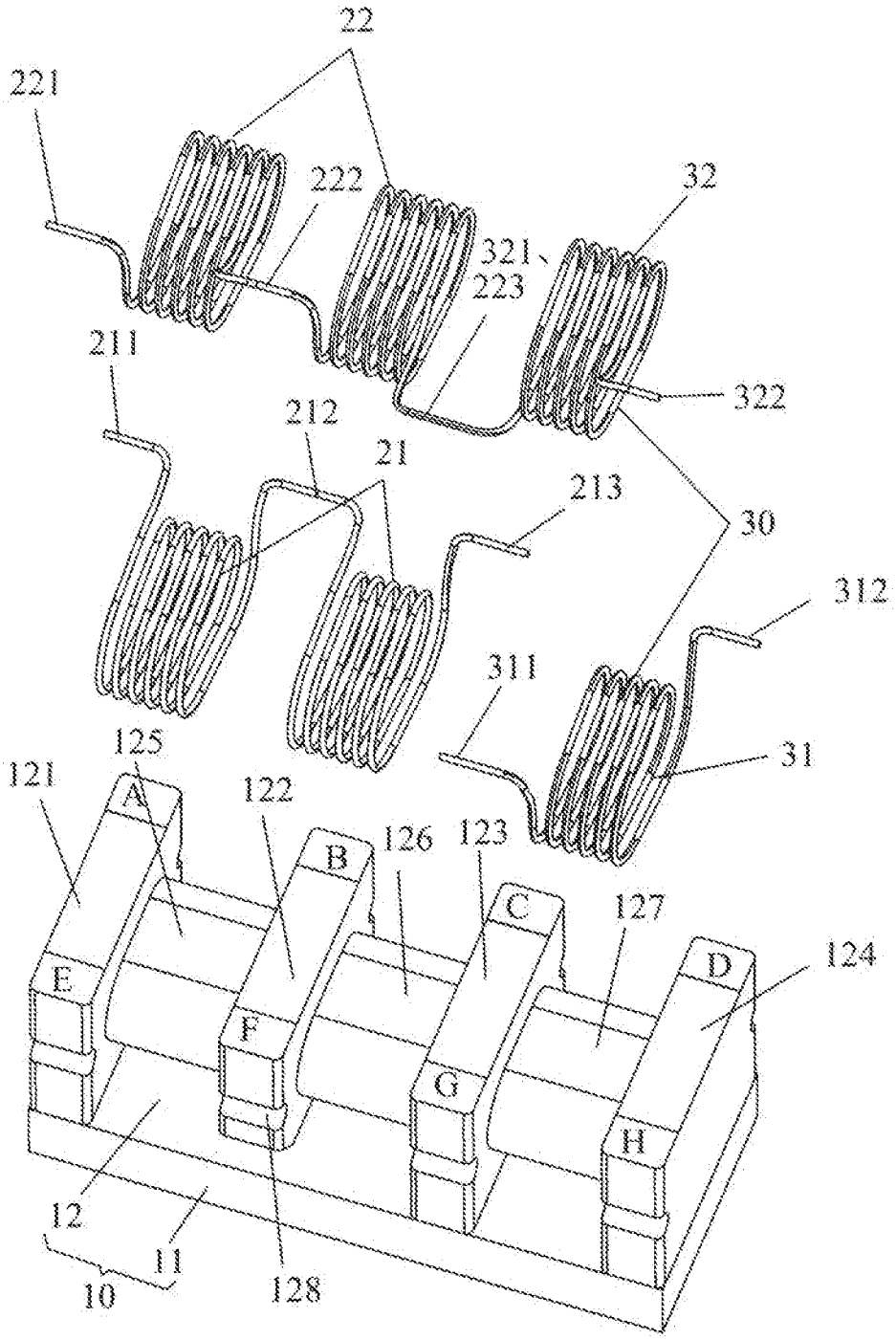
FIG. 2 is an exploded view of the network inductive device of FIG. 1 in accordance with the principles of the present disclosure.
Figure 3:
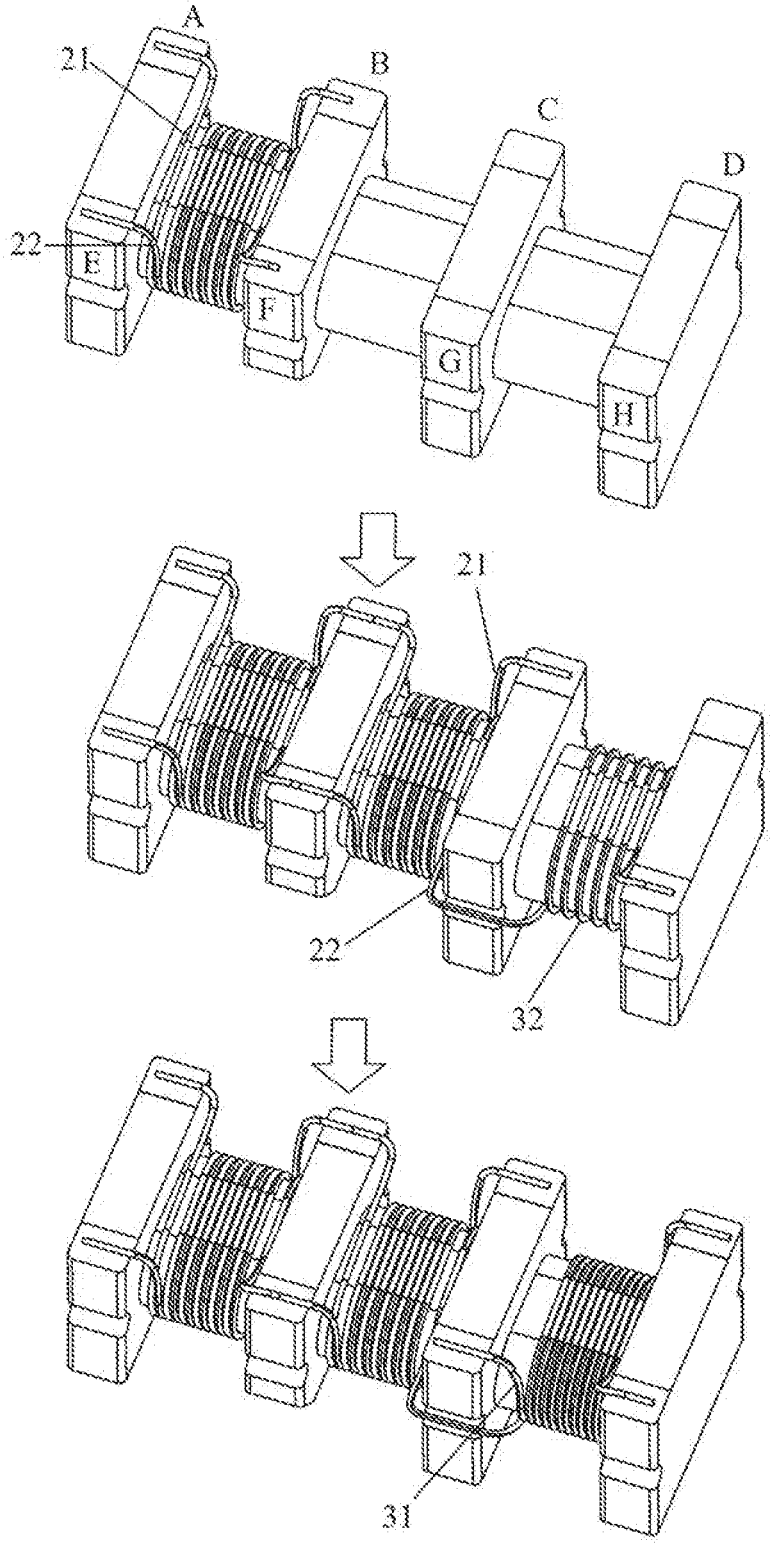
FIG. 3 is a series of perspective views of the network inductive device of FIG. 1 illustrating winding steps in accordance with some implementations of the present disclosure.
Figure 4:
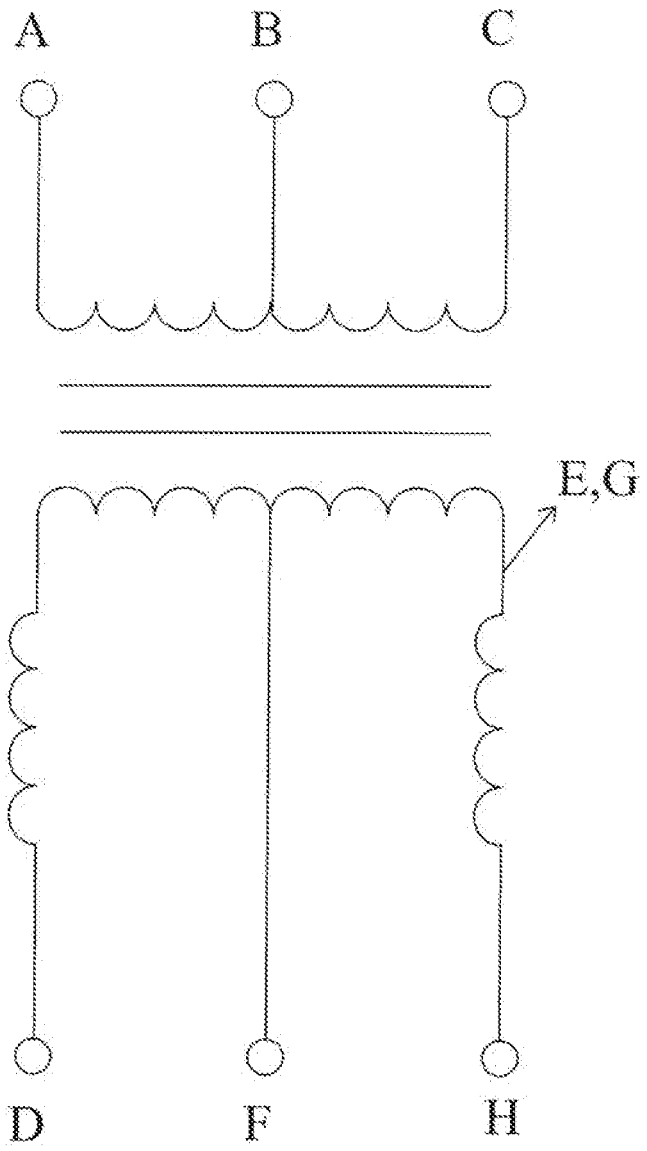
FIG. 4 is a circuit schematic diagram of the network inductive device of FIG. 1 in accordance with the principles of the present disclosure.

The common mode choke winding 30 includes a first winding 31 and a second winding 32. In some implementations, both the first winding 31 and the second winding 32 may have the same number of turns and phases, but are otherwise wound in an opposite direction from one another. In other words, and as can be seen in FIG. 2, the first winding 31 may be wound in a clock-wise orientation, while the second winding 32 may be wound in a counter clock-wise orientation. In some implementations, it may be desirable to wind the first winding 31 in a counter clock-wise orientation, while the second winding 32 may be wound in a clock-wise orientation. In yet other implementations, it may be desirable to wind the first winding 31 and the second winding 32 in the same winding direction (e.g., counter clock-wise or clock-wise). These and other variants would be readily apparent to one of ordinary skill given the contents of the present disclosure. Both the first winding 31 and second winding 32 may be wound onto the third winding barrel portion 127. A first end 311 of the first winding 31 may be secured to the terminal pad G, while a second end 312 of the first winding 31 may be secured to the terminal pad D.

In some implementations, the mechanism by which the first end 311 and the second end 312 are secured may include a resistive welding technique, although other methodologies (e.g., through the use of eutectic soldering operations) may be readily substituted in other implementations. A first end portion 321 of the secondary winding 32 may be coupled with an output end 223 of the secondary winding 22. In some implementations, the first end portion 321 and the output end 223 may constitute portions of the same conductive winding. A first end 311 of the first winding 31 may be secured onto the terminal pad G (e.g., using resistive welding techniques, eutectic soldering operations, etc.), while a second end 312 of the first winding is secured onto the terminal pad D (e.g., using resistive welding techniques, eutectic soldering operations, etc.). A first end 321 of the second winding 32 is coupled with an output end 223 of the secondary winding 22, while the second end 322 of the second winding 32 may be secured onto the terminal pad H using any number of appropriate methodologies.

In some implementations, terminal pads E and G may be connected to one another through an external conductive device 40 (e.g., a conductive wire), such that the input end 221 of the secondary winding 22 of the transformer and the first end 311 of the first winding 31 of the common mode choke are electrically coupled. In such a way, a transformer is formed between the first flange 121 and the third flange 123, and a common mode choke is formed between the third flange 123 and the fourth flange 124. In some implementations, it may be desirable to form the transformer between the first flange 121 and the second flange 122, while the common mode choke is formed between the second flange 122 and the fourth flange 124. These and other variants would be readily apparent to one of ordinary skill given the contents of the present disclosure.

The network transformer apparatus as depicted in FIGS. 1-4 enables a common magnetic core which can be used to perform the functions of both a transformer and a common mode choke winding using a single magnetic core 10

(composed of multiple I-shaped magnetic cores 12 and flat magnetic core 11) as opposed to prior implementations in which a separate core structure had to be utilized for both: (1) the transformer function; and (2) the common mode choke winding function. Such an implementation as shown in FIGS. 1-4 reduces costs by, inter alia, reducing the minutes-per-part (MPP) during the manufacturing process resulting in a reduced production costs for the network transformer apparatus, while also saving substrate (e.g., a PCB) space by reducing the overall device footprint (e.g., one device footprint may be reduced as compared with a two device footprint as with prior implementations). In other words, the network transformer apparatus depicted in FIGS. 1-4 includes a simplified structure that is easier to process by end device consumers, and lowers production costs thereby enabling its rapid integration into end device consumer bill of materials (BOMs).

A wire between the input end 211 and the center tap 212 of the primary winding 21 may be wound onto the first winding barrel portion 125, and a wire between the center tap 212 and the output end 213 of the primary winding 21 may be wound onto the second winding barrel portion 126; a wire between the input end 221 and the center tap 222 of the secondary winding 22 may be wound onto the first winding barrel portion 125, and a wire between the center tap 222 and the output end 223 of the secondary winding 22 may be wound onto the second winding barrel portion 126. In some implementations, this primary winding 21 and secondary winding 22 may be wound onto the multiple I-shaped magnetic cores 11 thereby reducing, inter alia, production MPP for the network transformer apparatus. In some implementations, an external conductive device 40 may include a PCB trace that is positioned on the end consumer PCB that is positioned between terminal pad E and terminal pad G.

In some implementations, the external conductive device 40 may include a length of wire or other conductive device that is positioned between terminal pad E and terminal pad G as is shown in, for example, FIG. 1. When a length of wire is chosen as the external conductive device 40, the wire may pass through a wire passing groove 128 on, for example, the front side wall of the second flange 122 thereby further reducing the overall network transformer apparatus footprint (e.g., such that the external conductive device 40 is positioned within the footprint occupied by the magnetic core module 10). Such an implementation may present a tidier network transformer apparatus appearance and may also reduce the opportunity for wire nicks and/or other wiring damage during the installation process for the network transformer apparatus. Wire passing grooves 128 may also be included on one (or both) of the first flange 121, the second flange 122, the third flange 123, and/or the fourth flange 124. Such an implementation may have the design benefits as described supra. In some implementations, one or more of the wire passing grooves 128 may instead include an aperture (e.g., a circular aperture, an oval-shaped aperture, etc.) as opposed to the wire passing grooves 128 illustrated. A connection between the output end 223 of the secondary winding of the transformer and the first thread 321 of the secondary winding of the common mode choke may pass through a wire passing groove 128 on a front side wall of the third flange 123.

A production method for the network transformer apparatus of FIGS. 1-4 is now described in which there are three main processing steps, namely: (1) a preparation step; (2) a winding step; and (3) a core assembly step. During the preparation step, the flat magnetic core 11 may be prepared (e.g., manufactured or procured). Additionally, the multiple integrated I-shaped magnetic cores 12 may be prepared (e.g., manufactured or procured). A first wire, a second wire, and a third wire may be prepared (e.g., manufactured or procured), where the first wire serves as a primary winding 21 of the transformer, a second wire serves simultaneously as a secondary winding 22 of the transformer and a second winding 32 of a common mode choke. The third wire may act as a first winding 31 of the common mode choke. These and other variations would be readily apparent to one of ordinary skill given the contents of the present disclosure.

During the winding step, one end of the first wire may be defined for use as an input end 211 of the primary winding of the transformer and may be secured onto terminal pad A (e.g., using resistive welding, soldering operations, etc.). One end of the second wire may be defined as an input end 221 of the secondary winding of the transformer and may be secured onto terminal pad E (e.g., using resistive welding, soldering operations, etc.). In some implementations, subsequent to being secured to the input ends 211, 221, the first wire and the second wire may be wound along the first winding barrel portion 125 in multiple turns. In some implementations, the first wire and the second wire may be wound simultaneously, so as to enable reduced MPP's for the network transformer apparatus winding process. In other variants, the first wire and the second wire may be wound sequentially such that, for example, the first wire is wound first followed by the winding of the second wire; or alternatively, the second wire is wound first followed by the winding of the first wire.

Next the winding step continues by extending the first wire to a terminal pad B and securing (e.g., using resistive welding, soldering operations, etc.) the first wire to terminal pad B. Terminal pad B now acts as a center tap 212 for the primary winding 21 of the network transformer apparatus structure. Simultaneously (or sequentially), the second wire is extended to terminal pad F and secured (e.g., using resistive welding, soldering operations, etc.) to terminal pad F. Terminal pad F now acts as a center tap 222 for the secondary winding 22 of the network transformer apparatus structure. In some implementations, upon securing the first and second wires to solder pads B and F, respectively, the winding process is continued onto the second winding barrel portion 126. Again, this winding process may be performed either simultaneously or sequentially. The first wire is extended to terminal pad C and secured (e.g., using resistive welding, soldering operations, etc.) to terminal pad C. The first wire now acts as the primary winding 21 for the network transformer apparatus. The second wire may be routed through a wire passing groove 128 on the front side wall of the third flange 123. This portion of the second wire routed within the wire passing groove 128 is designated as an output end 223 for the secondary winding 22 of network transformer apparatus.

Additionally, this portion of the second wire routed within the wire passing groove 128 is further designated as a starting end 321 of the second winding 32 of the common mode choke. The second winding 32 of the common mode choke is wound about the third winding barrel portion 127, where the finishing end 322 is secured (e.g., using resistive welding, soldering operations, etc.) to terminal pad H. The third wire is secured to terminal pad G and wound about the third winding barrel portion 127 in a number of turns. The second wire and the third wire may be wound simultaneously about the third winding barrel portion 127, or alternatively, these wires may be wound sequentially about the third winding barrel portion 127. After winding, the second and third wires wound about the third winding barrel portion 127, the finish end 312 of the third wire may be secured to terminal pad D, while the finish end 322 of the second wire may be secured to terminal pad H. Lastly, enabling the terminal pad E to be electrically coupled with terminal pad G may be accomplished through an external conductive device 40 (e.g., a separate wire, a trace on an external printed circuit board, etc.) such that the input end 221 of the secondary winding 22 is coupled with the first thread 311 of the first winding of the common mode choke. As previously discussed, in some implementations, the external conductive device 40 may be routed through the wire passing groove 128 located on the front side wall of the second flange 122.

During the core assembly step, the flat magnetic core 11 is bonded at the bottom of the multiple integrated I-shaped magnetic cores 12 so that the assembly constitutes a closed magnetic circuit (i.e., limits the magnetic fringing that occurs during operation of the network transformer apparatus). Some variants may include a mechanical securing feature (e.g., mechanical clips) in order to secure the flat magnetic core 11 with the multiple integrated I-shaped magnetic cores. In some implementations, this results in a transformer being formed between the first flange 121 and the third flange 123 and a common mode choke being formed between the third flange 123 and a fourth flange 124. As previously discussed, the adoption of the aforementioned network transformer apparatus results in a structure with eight (8) terminal pads that are formed on the multiple integrated I-shaped magnetic cores 12; and further only requires three (3) wires in order to complete the winding for the network transformer apparatus.

In addition, the winding process is simplified as the winding can be continued after intermediate processing steps. This is especially advantageous when using resistive welding techniques as the network transformer apparatus doesn't need to be removed from the winding machine during resistive welding operations. Additionally, in some implementations, the securing of the wires to the terminal pads doesn't require relocation of the wires during the resistive welding process thus further reducing costs (e.g., through the reduction of MPPs). The winding process is relatively simple, the winding process is efficient as extraneous processing techniques are avoided, and the requirements for the winding machine are low (i.e., the winding machines do not necessarily require expensive control and processing technologies in order to perform as intended). In addition, the network transformer architecture is highly suitable for automated production in part due to the aforementioned winding process and the relative easy assembly of the flat magnetic core 11 onto the multiple integrated I-shaped magnetic cores 12.

Figure 5:
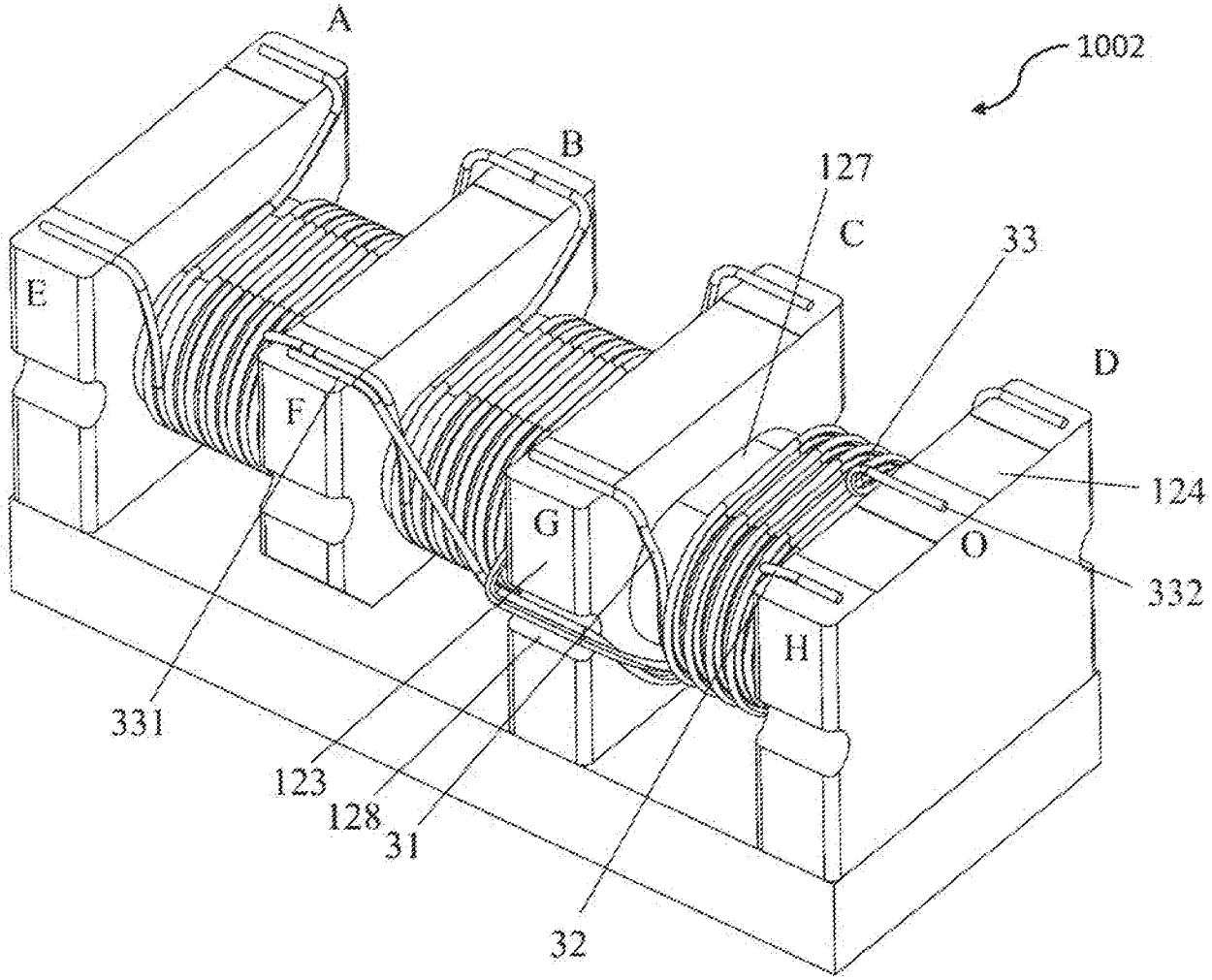
FIG. 5 is a perspective view of a second exemplary embodiment of a network inductive device in accordance with the principles of the present disclosure.
Figure 6:
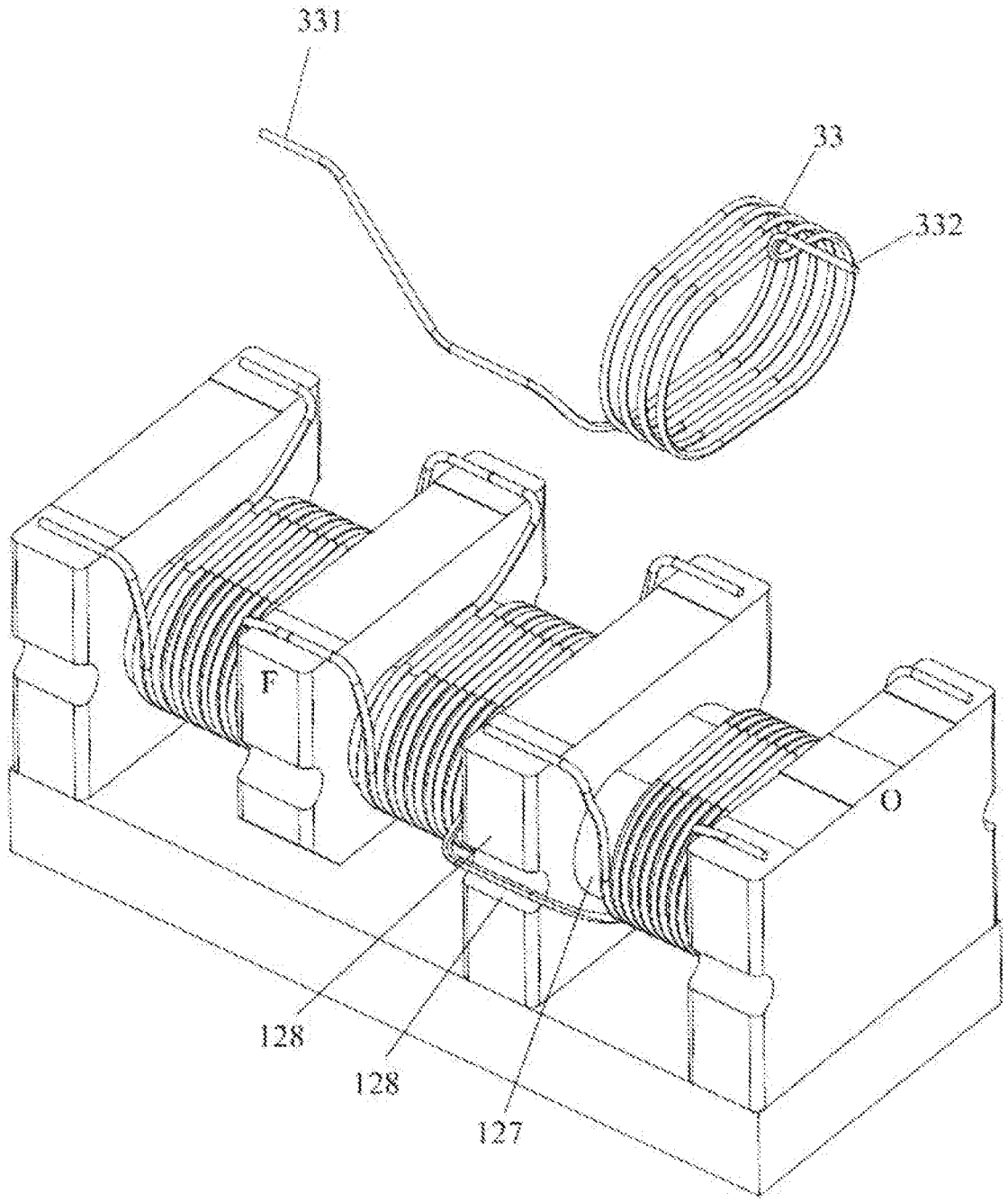
FIG. 6 is an exploded view of the network inductive device of FIG. 5 in accordance with the principles of the present disclosure.
Figure 7:
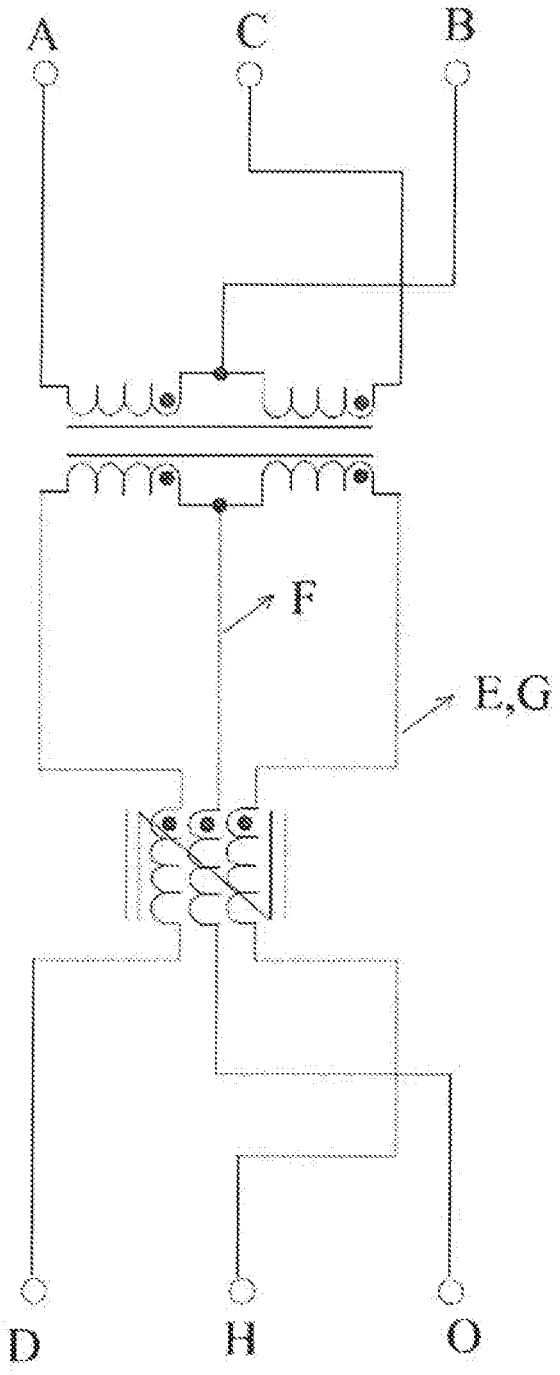
FIG. 7 is a circuit schematic diagram of the network inductive device of FIG. 5 in accordance with the principles of the present disclosure.

Referring now to FIGS. 5-7, a second exemplary embodiment of a network transformer apparatus 1002 is shown and described in detail. Much of the structure in the illustrated embodiment of FIGS. 5-7 is the same as that shown in the first embodiment of FIGS. 1-4, including, for example, a magnetic core module 10, a transformer winding 20, a common mode choke winding 30, where both the transformer winding 20 and the common mode choke winding 30 are wound on the same magnetic core module 10 so as to complete, inter alia, the function of the transformer and the common mode choke through a common part.

One difference between the structure illustrated in FIGS. 5-7 versus the structure illustrated in FIGS. 1-4 is that a terminal pad O has been added in the structure depicted in FIGS. 5-7. Accordingly, the implementation illustrated in FIGS. 5-7 includes a total of nine (9) terminal pads. In addition, a third winding 33 has been added onto the common mode choke winding 30, in which the terminal pad O is arranged on the fourth flange 124 that is located between terminal pad D and terminal pad H. The third winding 33, the first winding 31, and the second winding 32 are wound onto the third winding barrel portion 127. The first end 331 of the third winding 33 may be secured to terminal pad F (e.g., using resistive welding, soldering operations, etc.), while the second end 332 of the third winding 33 may be secured to terminal pad O.

As shown, due to the distance between terminal pad F and the third winding barrel portion 124, the corresponding portion of the third winding 33 may pass through the wire passing groove 128 on the side of the third flange 123. In the illustrated implementation, the common mode choke winding 30 has a three-wire output that include terminal pad H, terminal pad O, and terminal pad D respectively, which meet the common three-wire wiring requirements and can facilitate the network transformer structures connection with, for example, an existing universal connector lug. The circuit schematic for the network transformer structure illustrated in FIGS. 5 and 6 is thus illustrated as shown in FIG. 7.

The preparation methodology of the network transformer structure illustrated in FIGS. 5-7 is similar to that shown in the embodiment of FIGS. 1-4; however, the difference lies in the addition of a winding methodology for the third winding 33 (i.e., a fourth wire being added). During this winding methodology, the method for winding this third winding (fourth wire) is as follows: first one end of the fourth wire is defined as the first end 331 of the third winding 33 of the common mode choke; next the opposite end of the fourth wire is defined as the second end 332 of the third winding 33; the first end 331 of the third winding 33 is secured onto the terminal pad F (e.g., using resistive welding, soldering operations, etc.); the third winding is routed through the wire passing groove 128 on the side of the third flange 123; the central part of the fourth wire is wound onto the third winding barrel portion 127; and the second end 332 of the third winding 33 is secured onto the terminal pad O (e.g., using resistive welding, soldering operations, etc.) thus completing the function of the third winding 33. In some implementations, the third winding 33 is wound in a counter-clockwise orientation about the third winding barrel portion 127 as depicted in, for example, FIG. 6. In other implementations, the third winding may be wound in a clockwise orientation about the third winding barrel portion 127. The winding of the primary winding 21, the secondary winding 22 and the first winding 31 may be as described above with reference to FIGS. 1-4. Additionally, the assembly of the flat magnetic core 11 onto the magnetic core module 10 is as described above with reference to FIGS. 1-4.

Figure 8:
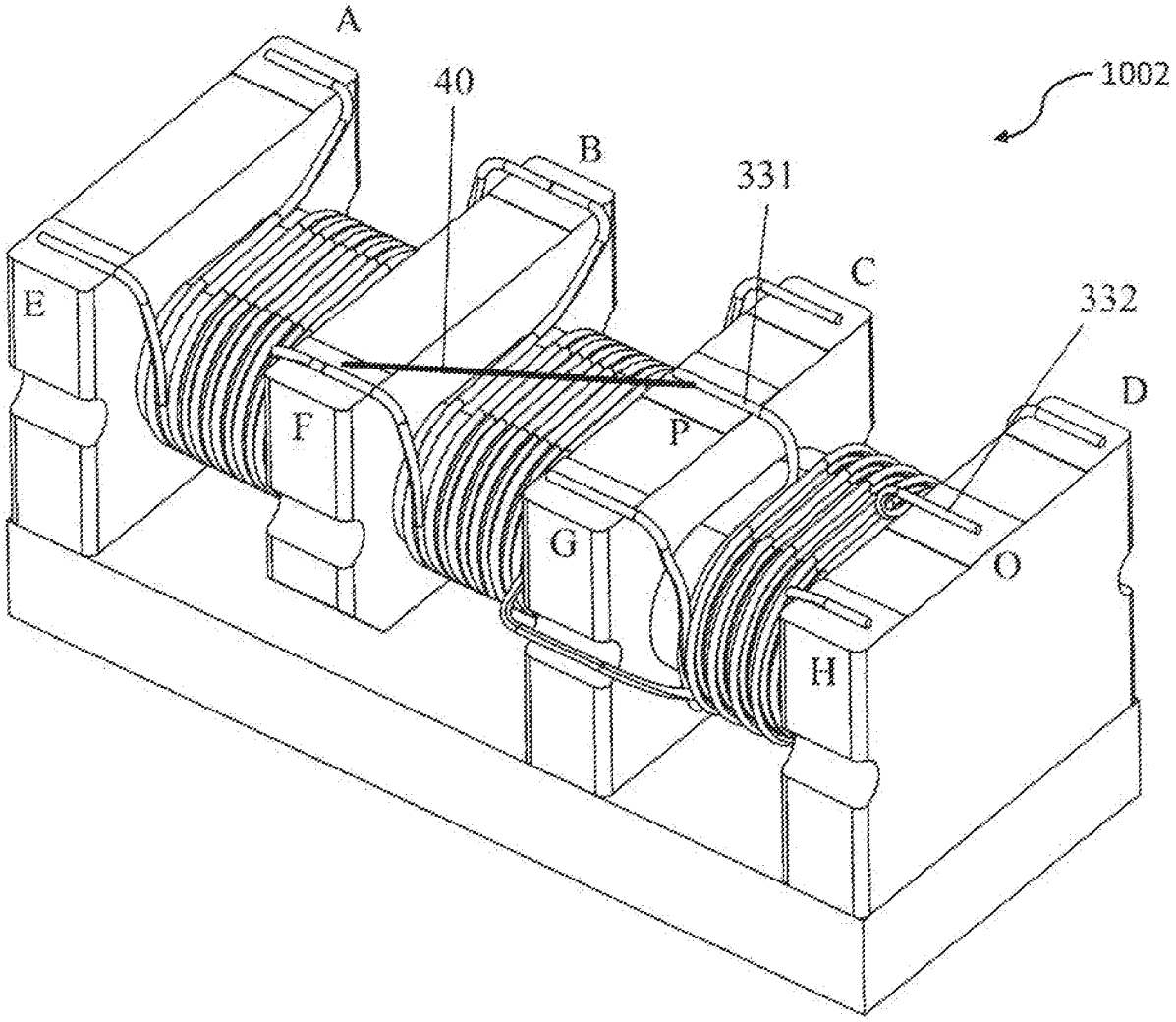
FIG. 8 is a perspective view of a third exemplary embodiment of a network inductive device in accordance with the principles of the present disclosure.
Figure 9:
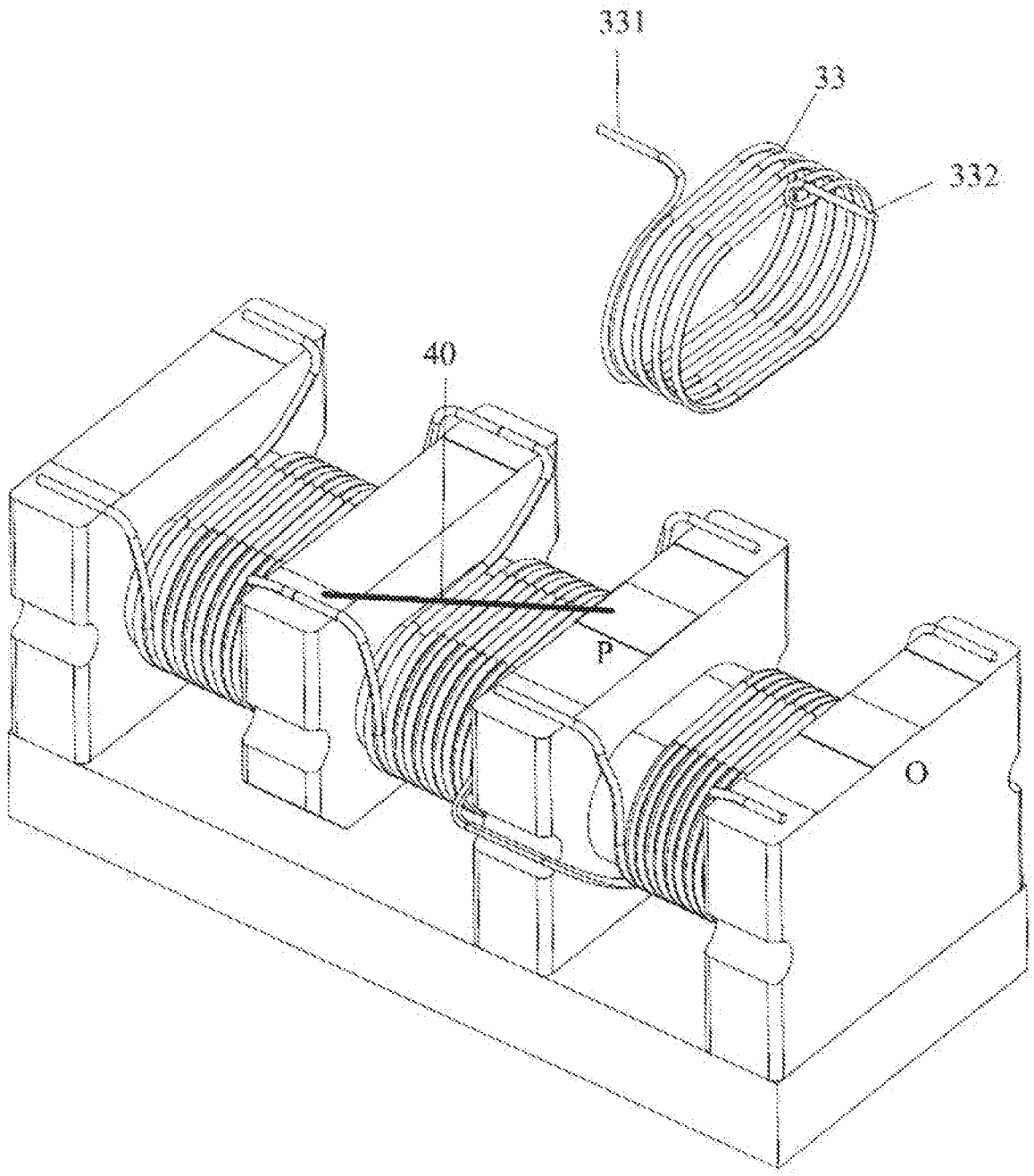
FIG. 9 is an exploded view of the network inductive device of FIG. 8 in accordance with the principles of the present disclosure.

Referring now to FIGS. 8-9, a third exemplary embodiment of a network transformer apparatus 1002 is shown and described in detail. Much of the structure in the illustrated embodiment of FIGS. 8-9 is the same as that shown in the second embodiment of FIGS. 5-7, including, for example, a magnetic core module 10, a transformer winding 20, a common mode choke winding 30, and a third winding 33, where both the transformer winding 20, the third winding 33 and the common mode choke winding 30 are wound on the same magnetic core module 10 so as to complete, inter alia, the function of the transformer and the common mode choke through a common part.

One difference between the structure illustrated in FIGS. 8-9 and the structure depicted in FIGS. 5-7 is that a terminal pad P has been added to the third flange 123 so that a total of ten (10) terminal pads are included. The first end 331 of the third winding 33 may be secured onto terminal pad P (e.g., using resistive welding, soldering operations, etc.) and the second end 332 of the third winding 33 is secured onto terminal pad O. A conductive device 40 (e.g., a conductive wire, a conductive trace located on an end customer PCB, etc.) is then utilized to electrically connect terminal pad P with terminal pad F.

Exemplary End Use Applications

Figure 10A:
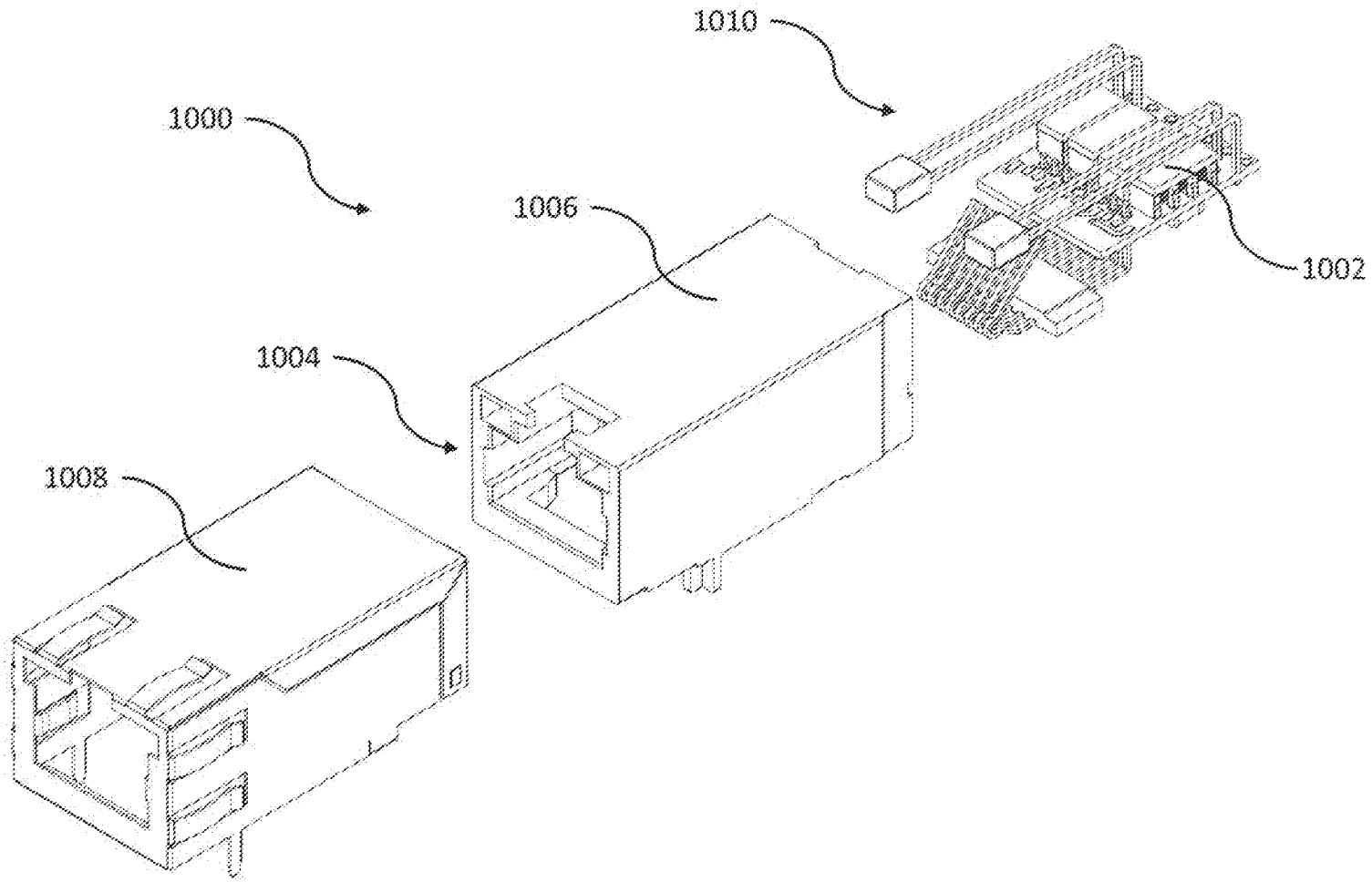
FIG. 10A is an exploded view of an exemplary integrated connector module (ICM) that incorporates any one of the aforementioned network inductive devices in accordance with the principles of the present disclosure.

Referring now to FIG. 10A, an exemplary integrated connector module 1000 is shown and described in detail in an exploded view. An ICM 1000 may include a connector housing 1006 with a connector port 1004 (e.g., an RJ-style connector port). The ICM may also include shielding 1008 (e.g., an electromagnetic interference (EMI) shield) that is configured to be positioned around the connector housing. A variety of ICMs that may include single port ICMs (such as that illustrated in FIG. 10A) or multi-port ICMs may be utilized in conjunction with the one or more of the aforementioned network transformer apparatus 1002, such as those described with respect to FIGS. 1-9. In the illustrated example, the network transformer apparatus 1002 is incorporated on a terminal insert assembly 1010.

While the ICM 1000 illustrated in FIG. 10A is exemplary, it would be readily apparent to one of ordinary skill given the contents of the present disclosure that other ICM designs and form factors may be readily substituted with equal success. Exemplary ICM designs and form factors that may be utilized in conjunction with the aforementioned network transformer apparatus 1002 are described in, for example, co-owned U.S. Pat. No. 7,241,181 issued on Jul. 10, 2007 and entitled "Universal Connector Assembly and Method of Manufacturing"; co-owned U.S. Pat. No. 7,845,984 issued on Dec. 7, 2010 and entitled "Power-Enabled Connector Assembly and Method of Manufacturing"; co-owned U.S. Pat. No. 8,147,278 issued on Apr. 3, 2012 and entitled "Integrated Connector Apparatus and Methods", each of the foregoing incorporated herein by reference in its entirety.

Figure 10B:
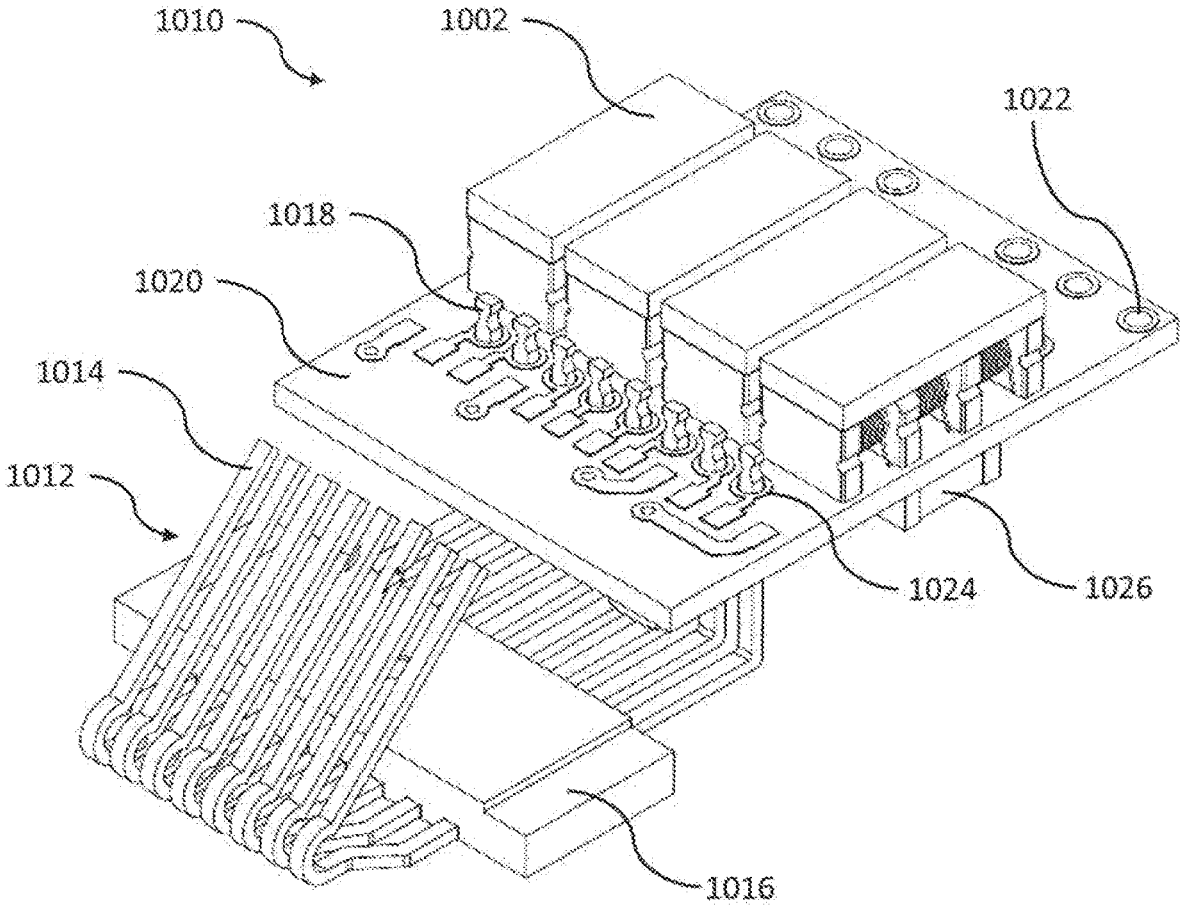
FIG. 10B is a perspective view of a terminal input assembly for use with the ICM of FIG. 10A in accordance with the principles of the present disclosure.

Referring now to FIG. 10B, one exemplary terminal insert assembly 1010 for use with, for example, an ICM (such as the ICM 1000 illustrated in FIG. 10B). In the illustrated embodiment, the terminal insert assembly 1010 includes a first set of terminals 1012. For example, the first set of terminal may be configured to be received within a connector port. The first set of terminals 1012 may include a plug contact portion 1014 and substrate contact portions 1018 as well as a polymer insert 1016 that is configured to position each one of the first set of terminals 1014 a predefined distance away from other ones of the first set of terminals. Such a predefined distance may also be known as a pitch. The substrate contact portions 1018 may be coupled with a substrate 1020 via the use of a through-hole interconnection technique as is shown in FIG. 10B. The substrate contact portions 1018 may also be coupled with a substrate 1020 via the use of a surface mount connection in some implementations.

The substrate 1020 may include apertures 1024, 1022. These apertures 1024, 1022 may be utilized for the first set of terminals 1012 and for terminals that are configured to couple, for example, an ICM 1000 to an external printed circuit board (i.e., an end consumer application printed circuit board). In some implementations, one or more of these apertures 1024, 1022 may be substituted with surface mountable pads that are configured to enable connection between, for example, the first set of terminals 1012 and the printed circuit board 1020. The printed circuit board 1020 may also include a plurality of traces that form the signaling paths between, for example, the first set of terminal apertures 1024 and the terminal apertures 1022 for connection with terminals that are configured to be coupled to an external printed circuit board. Additionally, the substrate 1020 may further include electronic components such as the aforementioned network transformer apparatus 1002 or other electronic components 1026 such as capacitors, resistors, inductors, active circuitry components, etc.

Figure 11:
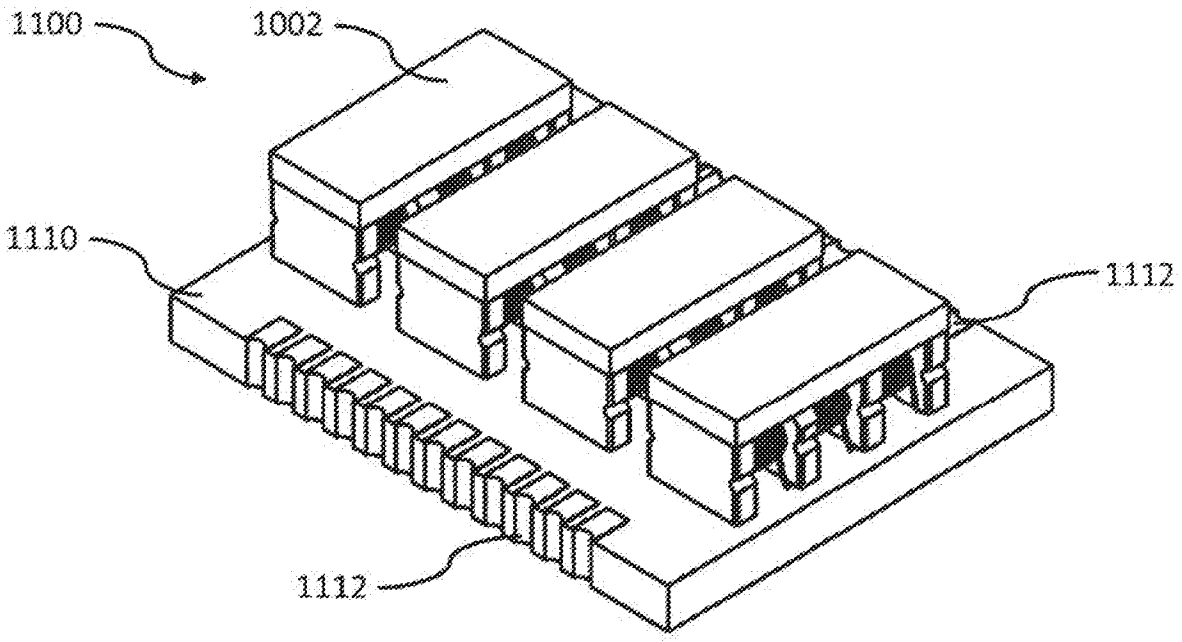
FIG. 11 is a perspective view of a discrete electronic device that incorporates any one of the aforementioned network inductive devices in accordance with the principles of the present disclosure.

Referring now to FIG. 11, a discrete electronic component 1100 is shown. For example, a discrete electronic component 1100 may include the signal conditioning functionality of the aforementioned ICM 1000 illustrated in FIG. 10A. The discrete electronic component 1100 may include a substrate 1110 as well as one or more electronic components (e.g., the network transformer apparatus 1002 as discussed elsewhere herein). Additionally, the discrete electronic component 1100 may include other electronic components (not shown) in some implementations. The printed circuit board 1110 may include a plurality of interface terminals 1112. For example, as illustrated in FIG. 11, the interface terminals 1112 may include surface mountable traces that are present on the printed circuit board 1110 itself. In alternative implementations, the interface terminals may include one or more of external metallic terminals that may be suitable for surface mounting (e.g., gull wing type terminals) or for through-hole mounting applications (e.g., through-hole terminals), or combinations of the foregoing. In some implementations, the discrete electronic component 1100 may include a polymer case (e.g., for the securing of the printed circuit board 1110 thereto). Such a polymer case (e.g., header) is described in co-owned U.S. Pat. No. 8,845,367 issued on Sep. 30, 2014 and entitled "Modular Electronic Header Assembly and Methods of Manufacture", the contents of which being incorporated herein by reference in its entirety. In some implementations, the printed circuit board may be encapsulated using, for example, transfer molding techniques such as those described in co-owned U.S. Pat. No. 6,691,398 issued on Feb. 17, 2004 and entitled "Electronic Packaging Device and Method", the contents of which being incorporated herein by reference in its entirety. These and other variants would be readily apparent to one of ordinary skill given the contents of the present disclosure.

It will be recognized that while certain aspects of the disclosure are described in terms of specific design examples, these descriptions are only illustrative of the broader methods, and may be modified as required by the particular design. Certain steps may be rendered unnecessary or optional under certain circumstances. Additionally, certain steps or functionality may be added to the disclosed embodiments, or the order of performance of two or more steps permuted. All such variations are considered to be encompassed within the disclosure and claims herein.

While the above detailed description has shown, described, and pointed out novel features of the disclosure as applied to various embodiments, it will be understood that various omissions, substitutions, and changes in the form and details of the device or process illustrated may be made by those skilled in the art. The foregoing description is of the best mode presently contemplated. This description is in no way meant to be limiting, but rather should be taken as illustrative of the general principles of the disclosure, the scope of which should be determined with reference to the claims.

What is claimed is:

1. A network transformer structure, comprising:

a magnetic core module, the magnetic core module comprising:

a planar magnetic core, and multiple I-shaped magnetic cores integral therewith, the magnetic core module further comprising a first flange, a transformer barrier, a third flange, and a fourth flange, each of the first flange, the transformer barrier, the third flange and the fourth flange collectively comprising a plurality of terminal pads;

a first winding barrel portion arranged between the first flange and the transformer barrier;

a second winding barrel portion arranged between the transformer barrier and the third flange; and a third winding barrel portion arranged between the third flange and the fourth flange;

a transformer winding, the transformer winding comprising a primary winding and a secondary winding, the primary winding and the secondary winding wound onto the first winding barrel portion and the second winding barrel portion;

wherein an input end of the primary winding is welded onto a first terminal pad of the plurality of terminal pads, a center tap of the primary winding is welded onto a second terminal pad of the plurality of terminal pads, and an output end of the primary winding is welded onto a third terminal pad of the plurality of terminal pads; and wherein an input end of the secondary winding is welded onto a fourth terminal pad, and a center tap of the secondary winding is welded onto a fifth terminal pad; and a common mode choke winding comprising a first winding and a second winding, both of said first and second windings having a same number of turns and phases, but wound in an opposite direction from one another, the first winding and the second winding wound onto the third winding barrel portion;

wherein a first end of the first winding is welded onto a sixth terminal pad of the plurality of terminal pads, and a second end of the first winding is welded onto a seventh terminal pad of the plurality of terminal pads; and wherein an output end of the secondary winding is welded onto the sixth terminal pad, and a second end of the secondary winding is welded onto an eighth terminal pad of the plurality of terminal pads.

2. The network transformer structure of claim 1, wherein the fourth terminal pad and the sixth terminal pad are connected through an external conductive device, so that the input end of the secondary winding of the transformer winding and the first end of the first winding of the common mode choke winding are connected.

3. The network transformer structure of claim 2, wherein the external conductive device that connects the fourth terminal pad and the sixth terminal pad comprises a wire, the wire configured to pass through a wire passing groove located on a front side wall of the transformer barrier.

4. The network transformer structure of claim 1, wherein the common mode choke winding further comprises a third winding;

the third winding, the first winding, and the second winding are wound onto the third winding barrel portion.

5. The network transformer structure of claim 4, wherein the fourth flange comprises a ninth terminal pad of the plurality of terminal pads;

a first end of the third winding is welded onto the fifth terminal pad; and a second end of the third winding is welded onto the ninth terminal pad.

6. The network transformer structure of claim 5, wherein a portion of wire of the third winding between the fifth terminal pad and the third winding barrel portion passes through a wire passing groove located on a side of the third flange.

7. The network transformer structure of claim 4, further comprising a tenth terminal pad located on the third flange;

a first end of the third winding welded onto the tenth terminal pad;

a second end of the third winding welded onto a ninth terminal pad; and wherein the tenth terminal pad and the ninth terminal pad are connected by a conductive device.

8. The network transformer structure of claim 1, wherein an external conductive device is disposed between a tenth terminal pad and a ninth terminal pad, the tenth terminal pad is disposed on the third flange and the tenth terminal pad is disposed on the fourth flange.

9. The network transformer structure of claim 8, wherein the external conductive device comprises a printed circuit board (PCB) trace.

10. The network transformer structure of claim 1, further comprising:

a plurality of wire passing grooves being arranged on two side walls of each of the first flange, the transformer barrier, the third flange, and the fourth flange; and a connection between an output end of the secondary winding of the transformer and the output end of the secondary winding of the common mode choke that passes through a wire passing groove on a front side wall of the third flange.

11. The network transformer structure of claim 1, wherein:

a first portion of wire between the input end of the primary winding and the center tap of the primary winding is wound onto the first winding barrel portion;

a second portion of wire between the center tap of the primary winding and an output end of the primary winding is wound onto the second winding barrel portion;

a third portion of wire between the input end of the primary winding and the center tap of the secondary winding is wound onto the first winding barrel portion; and a fourth portion of wire between the center tap of the secondary winding and the output end of the secondary winding is wound onto the second winding barrel portion.

12. The network transformer structure of claim 4, wherein:

the fourth flange comprises a ninth terminal pad, and a first end of the third winding is welded onto the fifth terminal pad, and a second end of the third winding is welded onto the ninth terminal pad.

13. The network transformer structure of claim 1, wherein the transformer barrier is configured to prevent magnetic flux from leaking between at least the first winding barrel portion and the second winding barrel portion.

14. A network transformer structure, comprising:

a magnetic core module comprising a planar magnetic core and a plurality of integrated I-shaped magnetic cores, the plurality of integrated I-shaped magnetic cores comprising a first winding barrel portion, a second winding barrel portion, and a third winding barrel portion, the planar magnetic core being disposed on the plurality of integrated I-shaped magnetic cores so as to form a closed magnetic structure; and a first flange disposed on a first end of the plurality of integrated I-shaped magnetic cores, a second flange disposed between the first winding barrel portion and the second winding barrel portion, a third flange disposed between the second winding barrel portion and the third winding barrel portion, and a fourth flange disposed on a second opposing end of the plurality of integrated I-shaped magnetic cores opposite the first end;

wherein the plurality of integrated I-shaped magnetic cores further comprise a transformer winding comprised of a primary winding and a secondary winding and a common mode choke winding;

wherein the primary winding and the secondary winding are disposed on the first winding barrel portion and the second winding barrel portion, and the common mode choke winding is disposed on the third winding barrel portion; and wherein the transformer winding is magnetically isolated from the common mode choke winding by virtue of the closed magnetic structure.

15. The network transformer structure of claim 14, wherein the common mode choke winding is comprised of a first winding and a second winding, the secondary winding comprised of a same piece of wire as the second winding; and wherein the third flange comprises a wire passing groove disposed on an external surface of the third flange, a portion of the same piece of wire being disposed in the wire passing groove.

16. The network transformer structure of claim 15, further comprising an external conductive device that connects a first terminal pad located on the third flange with a second terminal pad located on the second flange.

17. The network transformer structure of claim 15, further comprising an external conductive device that connects a first terminal pad located on the third flange with a second terminal pad located on the first flange.

18. The network transformer structure of claim 14, wherein the second flange disposed between the first winding barrel portion and the second winding barrel portion comprises a transformer barrier, the transformer barrier being configured to (i) contain magnetic flux generated by at least the first winding barrel portion from leaking into at least the second winding barrel portion, and (ii) contain magnetic flux generated by at least the second winding barrel portion from leaking into at least the first winding barrel portion.

19. The network transformer structure of claim 14, wherein the common mode choke winding comprises three ends that each terminate onto respective terminal pads located on the third flange or the fourth flange.

20. The network transformer structure of claim 19, wherein one of the respective terminal pads is located on the third flange and configured to be electrically connected to another terminal pad on the second flange.

21. The network transformer structure of claim 14, wherein the network transformer structure is configured to be physically and electronically coupled to a substrate, the substrate comprising one or more terminals, the one or more terminals having respective one or more contact portions.

* * * * *